US009469493B2

(12) United States Patent
Chen et al.

(10) Patent No.: US 9,469,493 B2
(45) Date of Patent: Oct. 18, 2016

(54) STACKING TRAY DEVICE

(71) Applicant: AVISION INC., Hsinchu (TW)

(72) Inventors: Chi-Yao Chen, Miaoli County (TW); Chao-Yu Peng, Hsinchu (TW); Sheng-Wei Fan, Hsinchu County (TW)

(73) Assignee: Avision Inc. (TW)

( * ) Notice: Subject to any disclaimer, the term of this patent is extended or adjusted under 35 U.S.C. 154(b) by 0 days.

(21) Appl. No.: 14/486,503

(22) Filed: Sep. 15, 2014

(65) Prior Publication Data

US 2015/0353301 A1 Dec. 10, 2015

(30) Foreign Application Priority Data

Jun. 5, 2014 (TW) ..... 103119507 A

(51) Int. Cl.

| | |
|---|---|
| ***B65H 1/00*** | (2006.01) |
| ***B65H 1/04*** | (2006.01) |
| ***B65H 9/04*** | (2006.01) |
| ***B65H 31/20*** | (2006.01) |
| ***B65H 1/02*** | (2006.01) |

(52) U.S. Cl.

CPC *B65H 1/04* (2013.01); *B65H 1/00* (2013.01); *B65H 1/02* (2013.01); *B65H 9/04* (2013.01); *B65H 31/20* (2013.01); *B65H 2402/64* (2013.01); *B65H 2511/12* (2013.01); *B65H 2511/22* (2013.01)

(58) Field of Classification Search

CPC ..... B65H 2511/12; B65H 2701/1131; B65H 1/00; B65H 2405/00; B65H 2405/1116; B65H 2405/112; B65H 2405/113; B65H 2405/114; B65H 2511/10

USPC ..... 271/145, 171

See application file for complete search history.

(56) References Cited

U.S. PATENT DOCUMENTS

| | | | | |
|---|---|---|---|---|
| 5,611,528 | A * | 3/1997 | Nakamura | B65H 1/266 271/164 |
| 6,116,591 | A * | 9/2000 | Kim | 271/171 |
| 6,332,610 | B1 * | 12/2001 | Hiura | 271/171 |
| 7,946,575 | B2 * | 5/2011 | Kim et al. | 271/171 |
| 2006/0180998 | A1 * | 8/2006 | Lee et al. | 271/171 |
| 2009/0026694 | A1 * | 1/2009 | Matsuoka | 271/171 |

FOREIGN PATENT DOCUMENTS

| | | | |
|---|---|---|---|
| CN | 1792751 | | 6/2006 |
| JP | 2-95628 | * | 4/1990 |

* cited by examiner

*Primary Examiner* — Thomas Morrison

(57) ABSTRACT

The present invention discloses a stacking tray device to be used for a business machine. The stacking tray device comprises a tray, a guide plate and a stopper, wherein paper is placed on the tray, the guide plate moves relative to the tray and restricts the size of the paper, and the stopper sets the position where the guide plate stops when the guide plate is pushed from the center towards the outside. When the stopper is in a lock position, the guide plate stops at a first position corresponding to a first standard paper size; when the stopper is in an unlock position, the guide plate stops at a second position corresponding to an oversized paper size.

14 Claims, 7 Drawing Sheets

STACKING TRAY DEVICE

CROSS REFERENCE TO RELATED APPLICATIONS

This application claims priority to Taiwanese patent application, No. 103119507, filed on Jun. 5, 2014, entitled "STACKING TRAY DEVICE", which is hereby incorporated by reference in its entirety.

BACKGROUND OF THE INVENTION

1. Field of the Invention

The present invention relates to a stacking tray device, particularly a stacking tray device to be used for a business machine.

2. Description of the Prior Art

Paper size is determined according to a specific ratio of width to length. Presently, the most widely used standard in the world is stipulated by the ISO, which names paper sizes A4, B5, etc. The international standard for paper sizes can be divided into three types: A, B and C. The unique feature of said standard lies in the fact that the ratio of length to width for paper sizes is $\sqrt{2}$ (approximately 1.4142). Differently sized paper of the same type have the same proportion, and therefore can be directly resized or photocopied without cropping the edges of the content on a page.

Currently in the U.S.A., Canada, Mexico, Bolivia, Colombia, Venezuela, the Philippines and Chile the official paper size is the Letter (LTR), also called the US Letter, which is 8.5 inches by 11 inches (215.9 mm by 279.4 mm). The Letter paper standard is adopted by the American National Standards Institute, while the A4 size (210 mm by 297 mm) is the ISO standard and is used by many countries. Letter paper is slightly shorter and wider than A4 paper. Generally speaking, the widest paper size is continuous form paper, which is 9.5 inches by 11 inches (241.3 mm by 279.4 mm), with holes along both the left and right edges of the paper.

Most business machines, such as fax machines, printers, copy machines, etc., are equipped with an open tray, whereupon the user may place paper and feed the paper into the business machine for copying, faxing or printing. There are various paper types and sizes, and when a small document is fed into a business machine with a larger feeding opening, the document becomes easily skewed. Skewing not only leads to inaccuracies in the output image, but also due to uneven pressure the paper may be wrinkled or damaged in the paper feeding process, a situation which should be avoided at all costs. Thus, trays on most business machines are equipped with two guide plates, such that when paper is placed in the space between said two guide plates, the distance between the two guide plates may be adjusted to match the width of the paper and restrict the width of the feeding opening, thus positioning the paper in the very center and preventing skewing from occurring during the paper feeding process. With conventional technology, the distance between the two guide plates is adjusted to the maximum before paper is placed on the tray. After paper is placed on the tray, the two guide plates are slowly retracted until they come into contact with the edge of the paper. The above method is both inconvenient and inaccurate.

Another conventional technology consists of labeling the tray with various paper sizes, such that the user can first adjust the two guide plates by aligning them with the appropriate label on the tray, and then place the paper on the tray. This method requires the user to carefully and deliberately move the guide plates and is therefore inconvenient.

Thus, there exists a need on the market for a new stacking tray device, which can reduce the occurrence of paper skewing during the paper feeding process and meet user demands for intuitive operation.

SUMMARY OF THE INVENTION

In view of the above market needs, the present invention provides the following embodiments.

In one embodiment, the present invention provides a stacking tray device to be used for a business machine. The aforementioned stacking tray device comprises a tray, a guide plate, and a stopper, wherein paper is placed on the tray, the guide plate moves relative to the tray and restricts the size of the paper, and the stopper sets the position at which the guide plate stops when said guide plate is pushed from the center towards the outside. When the stopper is in a lock position, the guide plate stops at a first position corresponding to a most commonly used paper size, which is referred to in this patent as "a first standard paper size"; when the stopper is in an unlock position, the guide plate stops at a second position corresponding to an oversized paper size.

In another embodiment, the present invention provides a stacking tray device to be used for a business machine. The aforementioned stacking tray device comprises a tray configured with a side wall on two opposing sides; two opposite guide plates configured to slide within the space between the two side walls and paper may be placed in the space between said guide plates; and a stopper positioned on the tray and adjacent a side wall, and said stopper can move between an unlock and lock position. When the stopper is in lock position, the guide plates can be pushed from the center towards the side walls until one of the guide plates is adjacent to the stopper, such that a first standard paper size may be placed in the space between the two guide plates. When the stopper is in unlock position, the guide plates can be pushed from the center towards the side walls until the guide plates are adjacent to the side walls, such that an oversized paper size may be placed in the space between the two guide plates.

In conclusion, the present invention provides a stacking tray device which provides the user an easily operable stopper to intuitively operate a first standard paper size and an oversized paper size.

DETAILED DESCRIPTION OF THE PREFERRED EMBODIMENTS

Figure 1A:
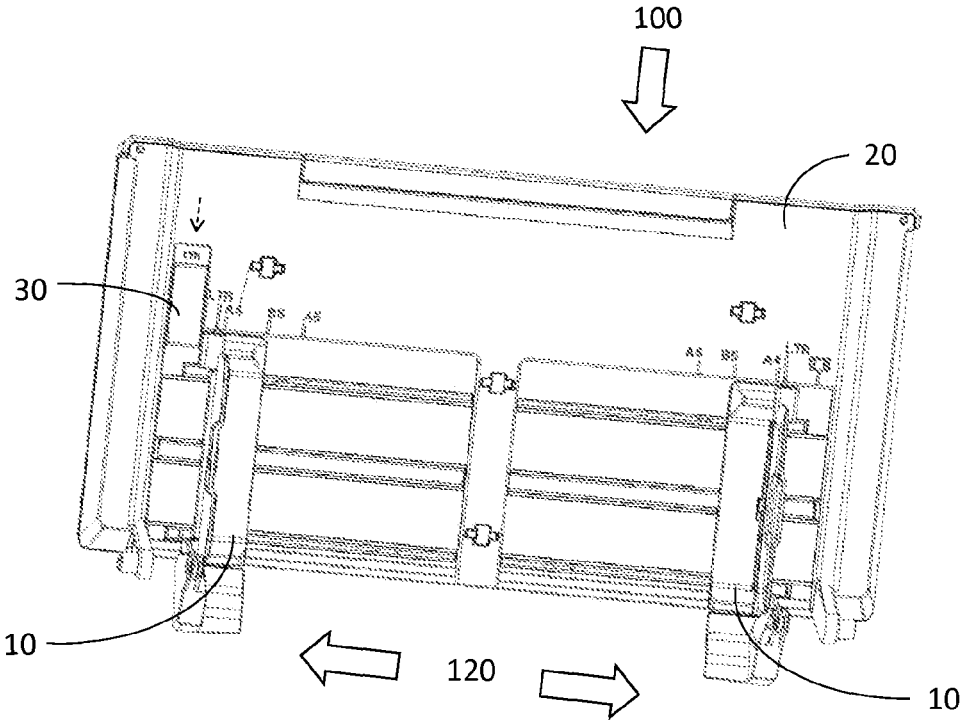
FIG. 1A depicts a schematic diagram of the stopper in a lock position according to an embodiment of the present invention.

Some embodiments of the present invention are described in detail below. However, in addition to these embodiments, the present invention is also applicable to other embodiments. The scope of the present invention is not limited to the embodiments below, but rather by the scope of the claims. Moreover, for better understanding and clarity of description, some components in the drawings may not necessarily be drawn to scale, as which some may be exaggerated relative to others and irrelevant parts may be omitted.

In the present invention, the definition of "paper" is not limited to the fibrous, sheet structure produced using machine or natural processes of breaking apart fibers, immersion in water, pressing and drying. In the present invention, "paper" may comprise printing paper, business cards, photo IDs, slides, plastic cards, photos, or other such sheet structures.

One embodiment of the present invention discloses a stacking tray device to be used for a business machine. The aforementioned stacking tray device comprises a tray, a guide plate, and a stopper, wherein paper is placed on the tray, the guide plate moves relative to the tray and restricts the size of the paper, and the stopper sets the position at which the guide plate stops when said guide plate is pushed from the center towards the outside. When said stopper is in a lock position, the guide plate stops at a first position corresponding to a first standard paper size; when said stopper is in an unlock position, the guide plate stops at a second position corresponding to an oversized paper size.

Figure 1B:
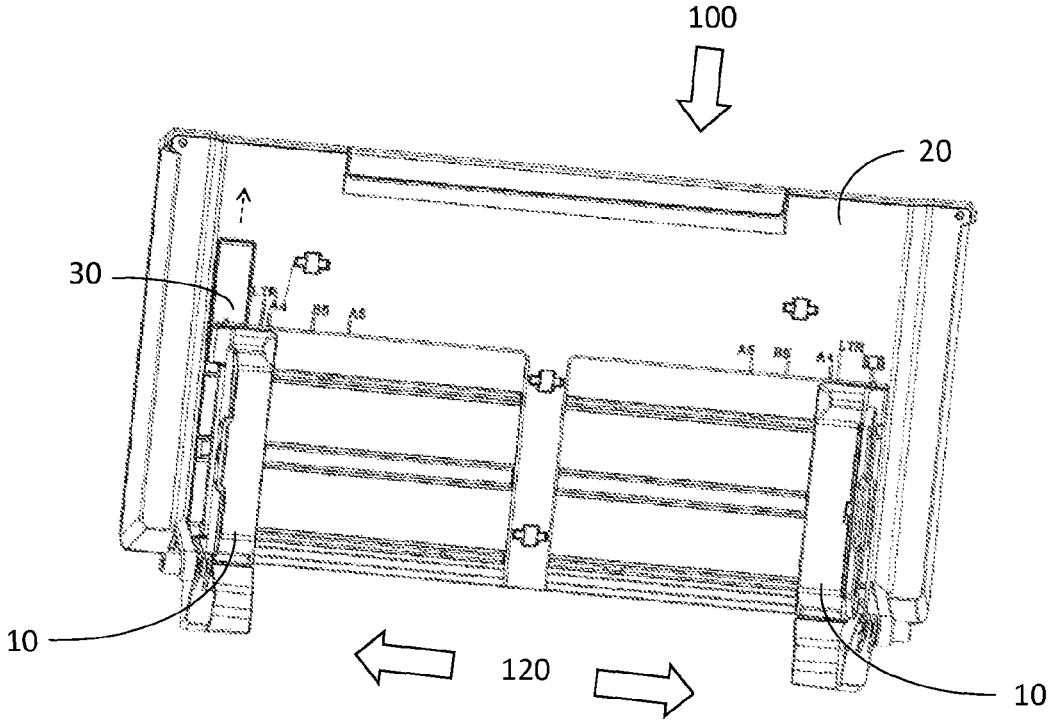
FIG. 1B depicts a schematic diagram of the stopper in an unlock position according to an embodiment of the present invention.

The direction of the movement of the guide plates could be perpendicular or parallel to the paper feed direction. Please refer to FIG. 1A and FIG. 1B. In one embodiment of the present invention, the direction of the movement of the guide plates is perpendicular to the paper feed direction 100, and a combination of two movable guide plates 10 is used. FIG. 1A and FIG. 1B show the relative positions of tray 20, guide plates 10 and stopper 30. FIG. 1A shows the stopper in a lock position, and when the guide plates 10 are pushed from the center towards the outside 120 they stop at a first position corresponding to a first standard paper size, such as Letter paper or A4 paper. FIG. 1A is based on Letter paper. FIG. 1B shows the stopper in an unlock position, and when the guide plates 10 are pushed from the center towards the outside 120 they stop at a second position corresponding to an oversized paper size, such as continuous form paper.

Generally, most automatic stacking tray devices are designed to fit the most commonly used paper size, such as Letter paper or A4 paper. Under such circumstances, there is no need to install a paper size detection device. However, as the need to use other paper sizes increases, it becomes necessary to install a paper size detection device to determine the size of the paper.

When users want to scan or print a document, first they place the paper on the tray, and then move the guide plates to fit the width of the paper. Thus, by moving the guide plates, the paper size detection device is notified concerning the size of the document.

Moreover, the size of the document (or paper) and the printing and/or scanning area corresponding to the stacking tray device do not need to be the same. For example, the left and right edges of continuous form paper with holes do not actually have any meaningful content. Thus, it is necessary to only scan or print the content in the middle, while avoiding the two edges along the sides with holes. In an embodiment of the present invention, the width of the printing and/or scanning area of the stacking tray device is shorter than the width of oversized paper. For example, by adjusting the guide plates, the stacking tray device can allow continuous form paper, but the width of the printing and/or scanning area will be the same as the width of Letter paper.

The two guide plates above may move using different drivers. Alternatively, the two guide plates may use one driver, such that when the user pushes one guide plate in one direction, the other guide plate will move in the opposite direction using the same driver.

Please refer to FIG. 1A and FIG. 1B. The direction of movement of the stopper 30 is perpendicular to the direction of movement of the guide plates 10. In an embodiment of the present invention, the stopper 30 is a sliding piece. Hence, the user may move the stopper 30 up or down by fingers, together with the movement of the guide plates 10 when pushed from the center towards the outside, to intuitively operate the first standard paper size or oversized paper size, since the user needs only push the guide plates 10 towards the outside as far as possible, regardless of whether the paper is the first standard paper size or oversized paper, and without having to read the markings of various sizes on the tray 20.

Figure 2A:
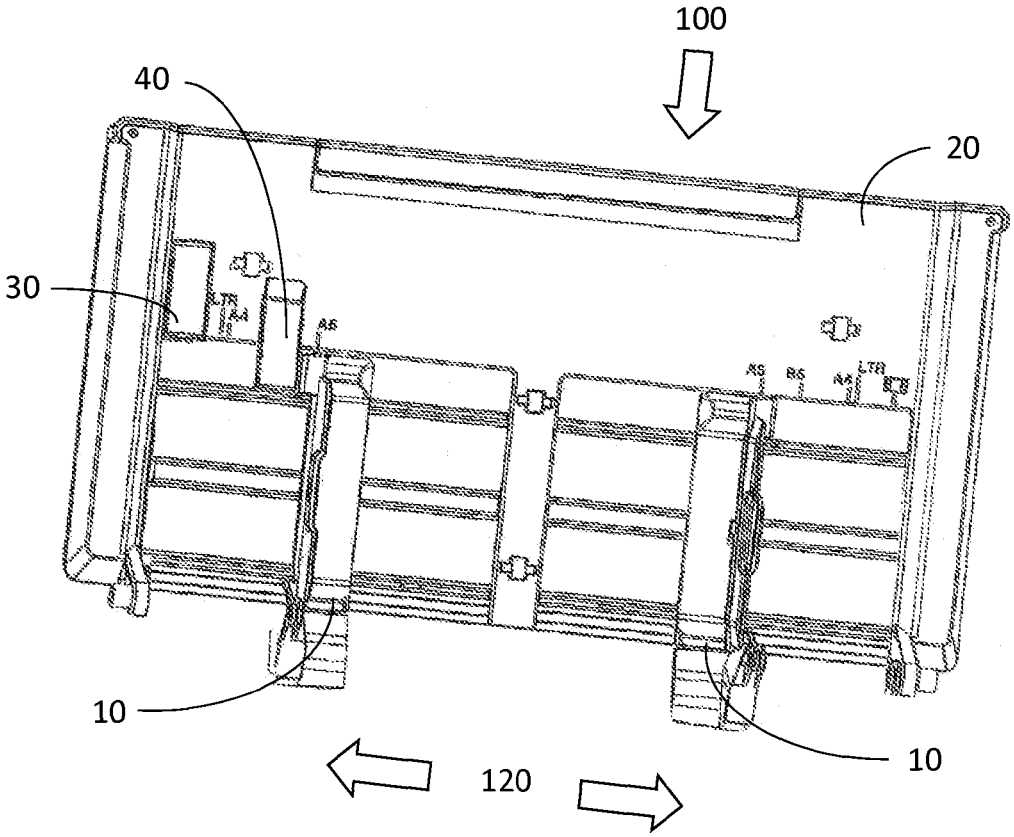
FIG. 2A depicts a schematic diagram of an auxiliary stopper in a lock position according to an embodiment of the present invention.
Figure 2B:
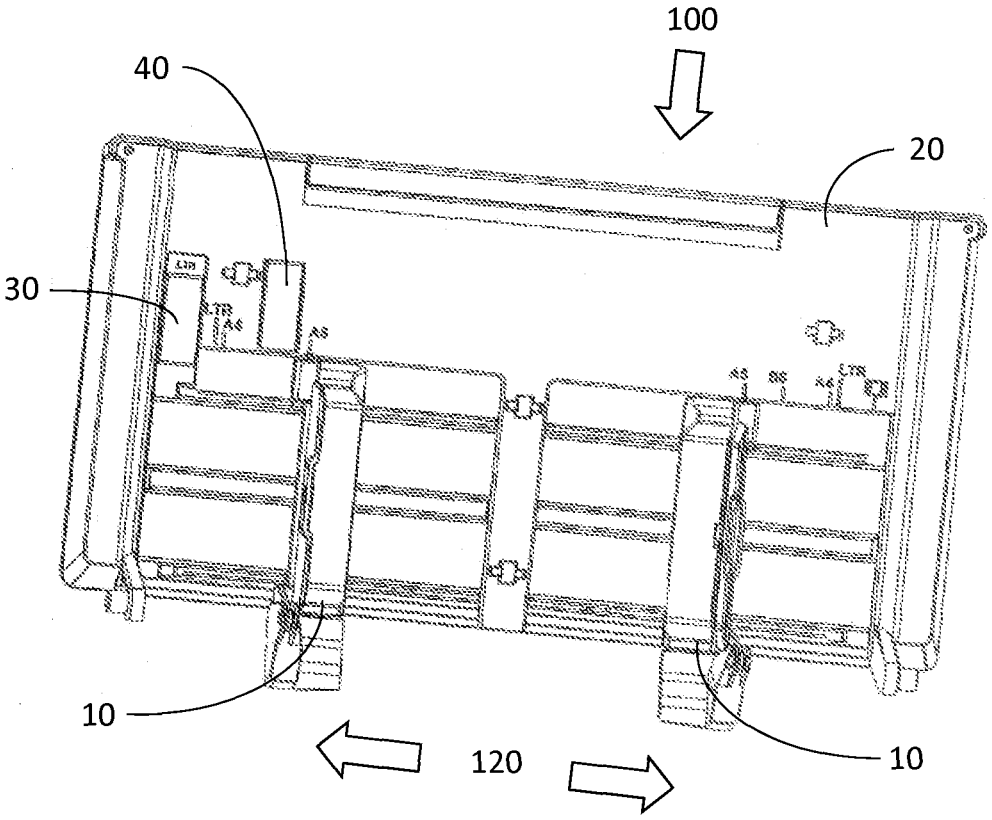
FIG. 2B depicts a schematic diagram of an auxiliary stopper in an unlock position according to an embodiment of the present invention.

Please refer to FIG. 2A and FIG. 2B. In an embodiment of the present invention, the stacking tray device further comprises an auxiliary stopper 40, such that when the guide plates 10 are pushed from the center towards the outside 140 the guide plates stop at a third position corresponding to a second most commonly used paper size, which is referred to in this patent as "a second standard paper size;" wherein the second standard paper size is smaller than the first standard paper size, and the direction of movement of the auxiliary stopper 40 is perpendicular to the direction of movement of the guide plates 10.

In one embodiment of the present invention, an auxiliary stopper 40 is a sliding piece. FIG. 2A shows the auxiliary stopper 40 in a lock position, such that the guide plates 10 stop at a third position corresponding to the second standard paper size, such as A5 paper size. FIG. 2B shows the auxiliary stopper 40 in an unlock position, such that the movement of the guide plates 10 is not restricted by the auxiliary stopper 40. In the present embodiment, the first standard paper size is A4 and the second standard paper size is A5. When the user places an A5 size paper on the tray, moving the auxiliary stopper 40 down to put it into lock position, such that when the guide plate 10 is pushed towards the outside, the guide plate 10 will stop at a position corresponding to A5 size paper. When an A4 size document is placed on the tray, the auxiliary stopper 40 is moved up and is put into unlock position. When oversized paper, such as continuous form paper, is placed on the tray, one can move the stopper 30 by fingers, as in the previous embodiment. Using simple actions, the user may freely and conveniently switch between the first standard paper size, the second standard paper size, and the oversized paper size.

Figure 3:
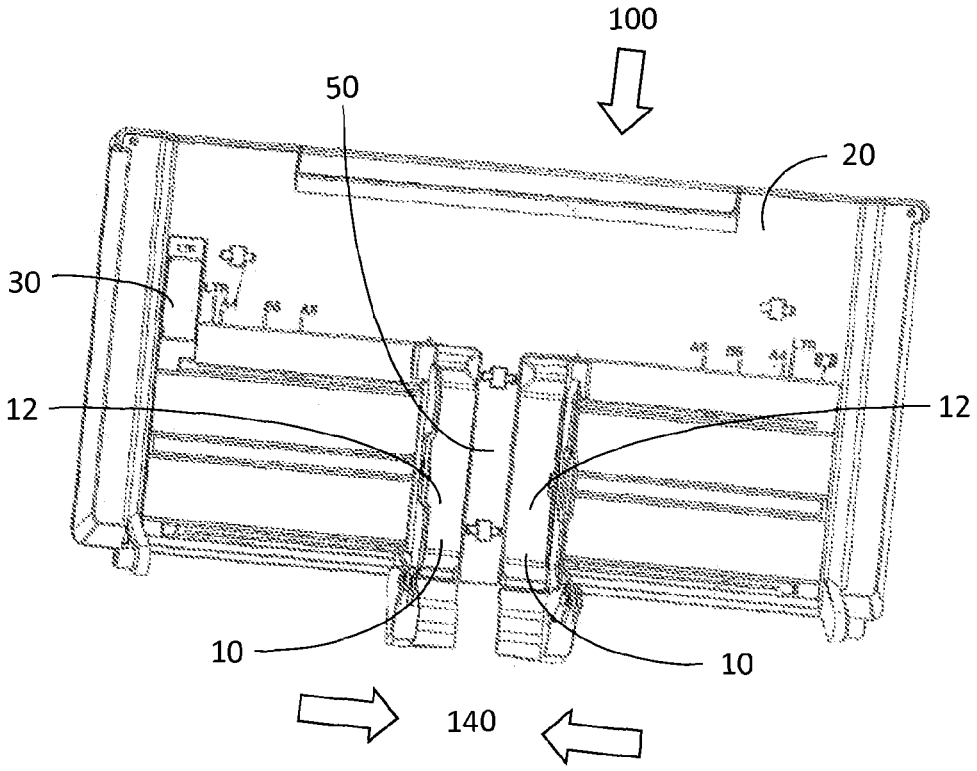
FIG. 3 depicts a schematic diagram of a central stopper and the guide plates according to an embodiment of the present invention.

Please refer to FIG. 3. In an embodiment of the present invention, the stacking tray device further comprises a central stopper 50, which is positioned in the center of the tray 20, such that when the guide plates 10 are pushed from the outside towards the center they stop at a fourth position. Each guide plate 10 comprises a base plate 12 of a certain width. Hence, the guide plates 10 and the central stopper 50 together form a space for accommodating the smallest paper size, such as an ID or credit card. The central stopper may take the shape of a strip.

Figure 4A:
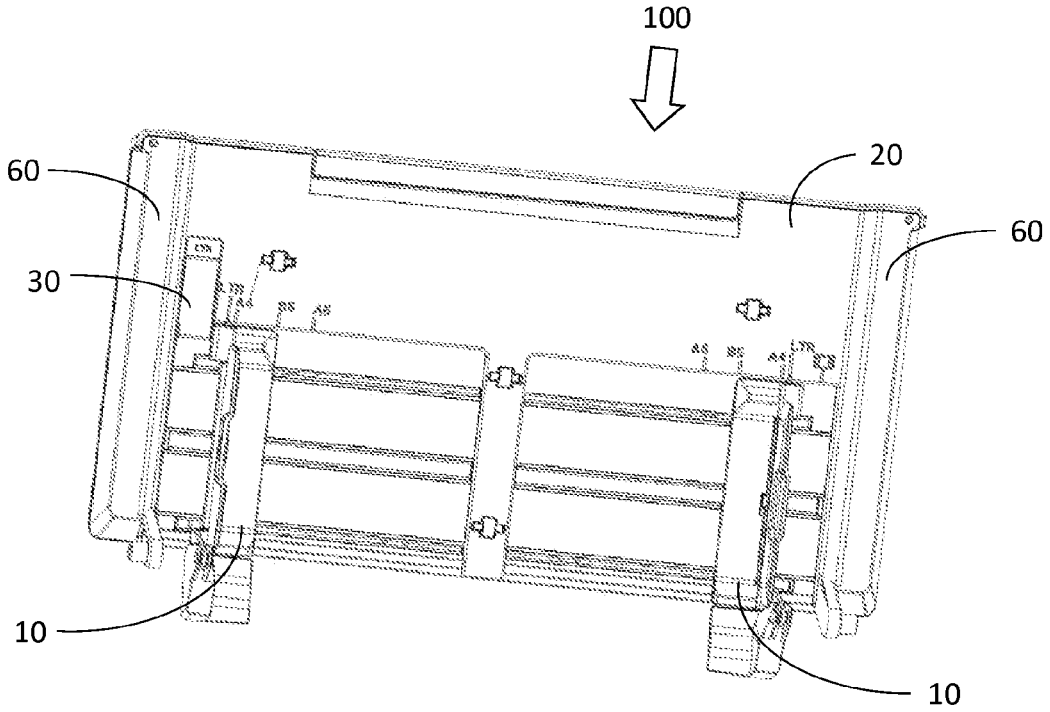
FIG. 4A depicts a schematic diagram of the stopper and side walls according to another embodiment of the present invention.
Figure 4B:
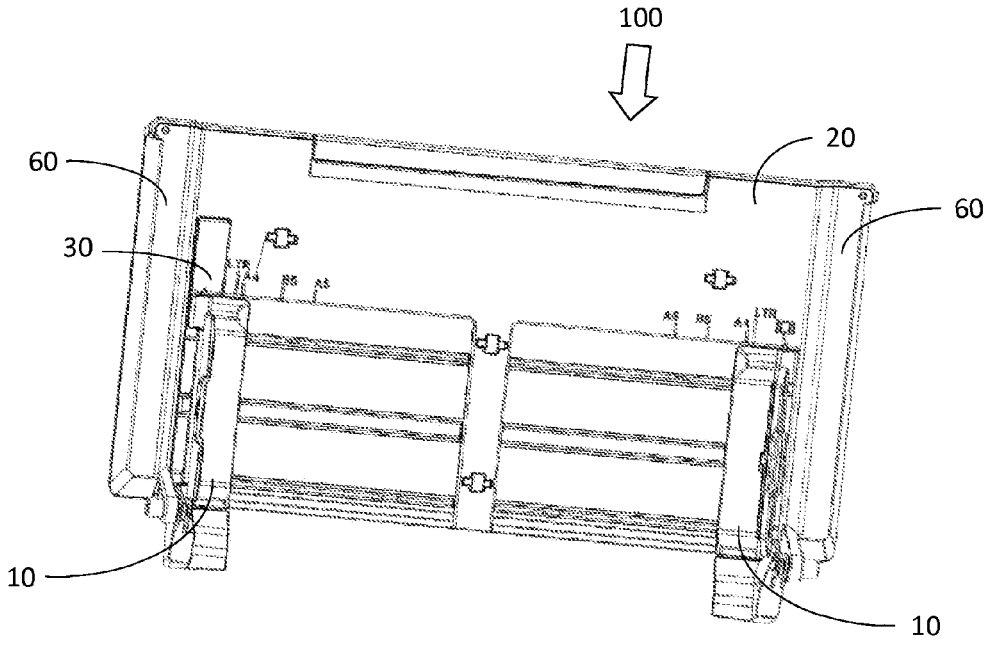
FIG. 4B depicts a schematic diagram of the stopper and side walls according to another embodiment of the present invention.

Please refer to FIG. 4A and FIG. 4B. One embodiment of the present invention discloses a stacking tray device to be used for a business machine. The aforementioned stacking tray device comprises a tray 20, a side wall 60 on each of the two sides of the tray 20, two opposite guide plates 10 configured to slide within the space between the two side walls 60, and paper may be placed in the space between the two guide plates 10, and a stopper 30, positioned on the tray 20 and adjacent to one of side walls 60, wherein the stopper 30 may move between an unlock and lock position. As shown in FIG. 4A, when said stopper 30 is in lock position, the guide plates 10 may be pushed from the center towards the side walls 60 until one of the guide plates 10 is adjacent to the stopper 30, such that a first standard paper size may be placed in the space between the two guide plates 10. As shown in FIG. 4B, when said stopper 30 is in unlock position, the guide plates 10 may be pushed from the center towards the side walls 60 until the guide plates 10 are adjacent to the side walls 60, such that an oversized paper size may be placed in the space between the two guide plates 10.

The above described embodiments are only preferred embodiments of the present invention and are not intended to limit the scope of this invention patent; Any other equivalent changes or modifications may be made without departing from the present invention, which is disclosed in the following claims.

What is claimed is:

1. A stacking tray device to be used for a business machine, wherein said stacking tray device comprises:

a tray, comprising a surface whereupon paper may be placed;

a guide plate configured to move in a first direction corresponding to a width of the tray relative to the tray for restricting a size of the paper; and a first stopper configured to be linearly slidable in a second direction corresponding to a paper feed direction from a first unlock position to a first lock position to set a first predetermined paper size position where the guide plate stops when said guide plate is pushed from a center of the tray towards an outside of the tray, wherein when the guide plate moves relative to the tray, the guide plate also moves relative to the first stopper;

wherein, when said first stopper is positioned on the surface of the tray and is in said first lock position, the guide plate stops at the first predetermined paper size position corresponding to a first standard paper size as the guide plate is pushed from the center toward the outside until the guide plate is adjacent to the first stopper; and when said first stopper is positioned on the surface of the tray and is in said first unlock position, the guide plate stops at a second predetermined paper size position corresponding to an oversized paper size as the guide plate is pushed from the center toward the outside.

2. The stacking tray device of claim 1, wherein a width of a printing and/or scanning area corresponding to said stacking tray device is shorter than a width of the oversized paper size.

3. The stacking tray device of claim 1, wherein the direction of movement of the first stopper is perpendicular to the direction of movement of the guide plate.

4. The stacking tray device of claim 1, further comprising an auxiliary stopper configured to be linearly slidable in said second direction from a second unlock position to a second lock position to set a third predetermined paper size position where the guide plate stops when said guide plate is pushed from the center of the tray towards the outside of the tray, said third predetermined paper size position corresponds to a second standard paper size, said second standard paper size is smaller than said first standard paper size, and the direction of movement of said auxiliary stopper is perpendicular to the direction of movement of the guide plate.

5. The stacking tray device of claim 1, further comprising a central stopper configured to set a fourth predetermined paper size position where the guide plate stops when said guide plate is pushed from the outside of the tray towards the center of the tray, and said fourth predetermined paper size position corresponds to a minimum paper size.

6. The stacking tray device of claim 5, wherein the position of said central stopper is fixed.

7. The stacking tray device of claim 1, wherein said first standard paper size is either Letter or A4.

8. The stacking tray device of claim 1, wherein said oversized paper size is continuous form paper.

9. The stacking tray device of claim 1, wherein said paper comprises printing paper, business cards, photo IDs, slides, plastic cards or photos.

10. The stacking tray device of claim 4, wherein said auxiliary stopper is a sliding piece.

11. The stacking tray device of claim 1, wherein said first stopper is slid in parallel of the paper feed direction.

12. The stacking tray device of claim 4, wherein said auxiliary stopper is slid in parallel of the paper feed direction.

13. A stacking tray device, to be used for a business machine, wherein said stacking tray device comprises:

a tray configured with a side wall on each of two opposing sides, wherein the tray comprising a surface whereupon papers may be placed;

two opposite guide plates configured to slide within a space between the two side walls in a first direction corresponding to a width of the tray and paper may be placed in the space between said guide plates; and a first stopper positioned on the tray and adjacent to one of the side walls, and said first stopper is configured to be linearly slidable in a second direction corresponding to a paper feed direction from a first unlock position to a first lock position and can move between said first unlock position and said first lock position;

wherein, when the first stopper is positioned on the surface of the tray and is in the first lock position, the guide plates can be pushed from a center of the tray towards the side walls until one of the guide plates is adjacent to the first stopper, such that a first standard paper size may be placed in the space between the two guide plates; when the first stopper is positioned on the surface of the tray and is in the first unlock position, the guide plates can be pushed from the center of the tray towards the side walls until the guide plates are adjacent to the side walls, such that an oversized paper size may be placed in the space between the two guide plates.

14. The stacking tray device of claim 13, wherein said first stopper is slid in parallel of the paper feed direction.

* * * * *